United States Patent [19]

Nayler et al.

[11] Patent Number: 4,688,764

[45] **Date of Patent: * Aug. 25, 1987**

[54] CROWN BLOCK COMPENSATOR

[75] Inventors: Douglas W. J. Nayler, Mission Viejo, Calif.; Fred R. Foreman, London, England; Willard D. Childs, Encinitas, Calif.

[73] Assignee: NL Industries, Inc., New York, N.Y.

[ * ] Notice: The portion of the term of this patent subsequent to Nov. 4, 2003 has been disclaimed.

[21] Appl. No.: 707,969

[22] Filed: Mar. 4, 1985

Related U.S. Application Data

[63] Continuation-in-part of Ser. No. 666,874, Oct. 31, 1984, Pat. No. 4,620,692.

[51] Int. Cl.[4] ..... B63B 23/02; B63B 23/70

[52] U.S. Cl. ..... 254/277; 254/900

[58] Field of Search ..... 254/277, 392, 413, 900

[56] References Cited

U.S. PATENT DOCUMENTS

| | | | |
|---|---|---|---|
| 3,469,820 | 9/1969 | Horton | 254/277 |
| 3,799,505 | 3/1974 | Duncan | 254/274 |
| 3,804,183 | 4/1974 | Duncan et al. | 254/900 X |
| 3,841,770 | 10/1974 | Childs | 403/106 |
| 3,877,489 | 4/1975 | Louis et al. | 138/46 |
| 3,877,680 | 4/1975 | Childs et al. | 254/394 |
| 4,025,055 | 5/1977 | Strolenberg | 254/277 X |
| 4,272,059 | 6/1981 | Noeragen et al. | 254/392 |

FOREIGN PATENT DOCUMENTS

| | | | |
|---|---|---|---|
| 2066762 | 7/1981 | United Kingdom | 254/277 |

OTHER PUBLICATIONS

Crown Mounted Drill String Compensator by Maritime Hydraulics, undated.

Crown Block Heave Compensator by Western Gear Corporation, undated.

*Primary Examiner*—Stuart S. Levy
*Assistant Examiner*—Katherine Matecki
*Attorney, Agent, or Firm*—Browning, Bushman, Zamecki & Anderson

[57] ABSTRACT

Disclosed is a compensator applicable for use with a traveling block supported from a mast, derrick or the like by means of a crown block wherein the traveling block may be utilized for supporting objects. Two fluid pressure piston-and-cylinder assemblies are arrayed on opposite sides of a line of travel of the traveling block relative to the crown block so that a flexible line positioned about the sheaves of both blocks passes over a pulley supported by one fluid pressure assembly to one side of the line of travel and, on the other side, the flexible line passes over a pulley supported by the other fluid pressure assembly. One end of the flexible line may be anchored relative to the mast as a deadline while the line at its other end may be selectively retracted or payed out by a drawworks or the like fixed relative to the mast. In one embodiment, the pulleys are carried by a carriage which is carried by the fluid pressure assemblies. The crown block is supported by flexible lines passing over pulleys also supported by the fluid pressure assemblies. In another embodiment, the fluid pressure assemblies directly support the crown block, and pulley assemblies are supported by flexible lines between the crown block and the mast, and include pulleys over which the flexible line connecting the two blocks passes. With the drawworks holding the first flexible line fixed, the crown block and the traveling block may move in unison relative to the mast with proportional reciprocable movement on behalf of each of the fluid pressure assemblies while the traveling block remains stationary relative to the crown block. Operation of the drawworks to retract or pay out the line results in manipulation of the traveling block relative to the crown block regardless of movement of the two blocks relative to the mast.

26 Claims, 16 Drawing Figures

FIG. 8
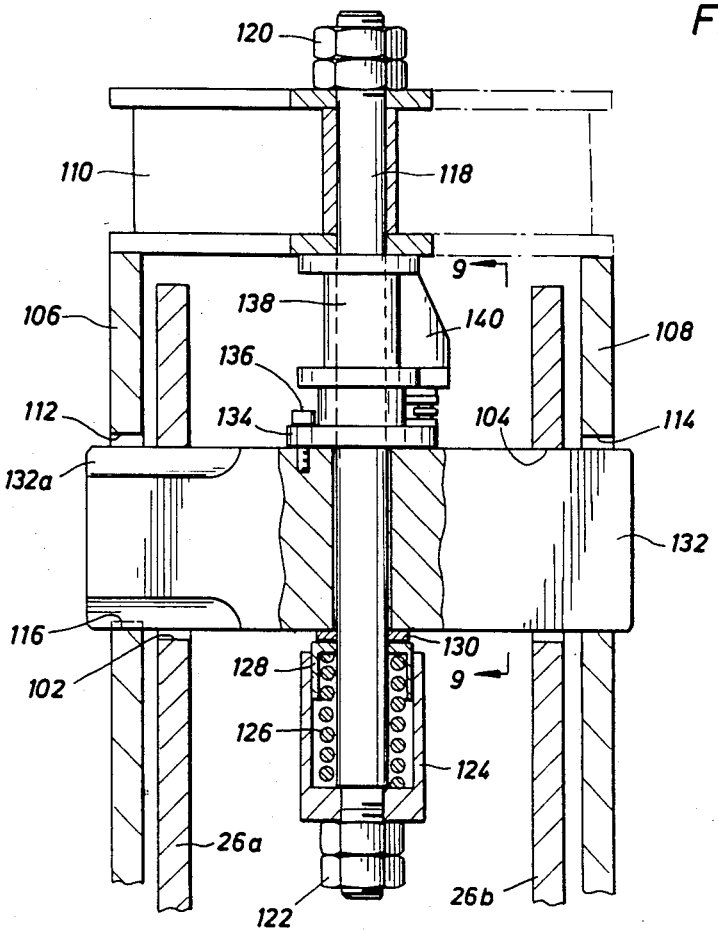
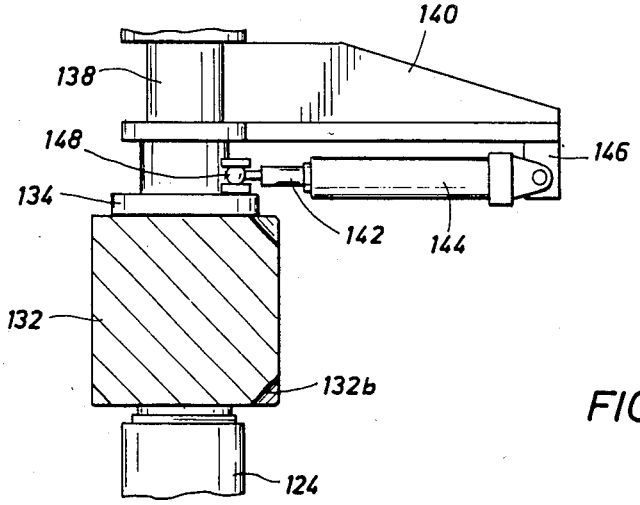
FIG. 9

CROWN BLOCK COMPENSATOR

CROSS REFERENCE

This application is a continuation-in-part application of co-pending U.S. patent application Ser. No. 666,874, filed Oct. 31, 1984, now U.S. Pat. No. 4,620,692, issued Nov. 4, 1986.

BACKGROUND OF THE INVENTION

1. Field of the Invention

The present invention pertains to apparatus for supporting and manipulating equipment. More particularly, the present invention relates to support apparatus of the type utilizing blocks and lines, such as a traveling block, to which equipment may be connected, and a crown block from which the traveling block is suspended by means of a line arrayed between sheaves forming parts of the two blocks. The present invention finds particular application in environments wherein such block arrangements are supported by floating vessels and used to manipulate equipment relative to the floor of the body of water supporting the vessel, or in environments wherein soft landings of equipment are desired.

2. Description of Prior Art

Motion compensators are known for compensating for the vertical heaving of marine vessels supporting submerged equipment during drilling or other undersea well operations. Such compensators include traveling block compensators wherein a hook, elevator or the like by which equipment may be connected to a traveling block is suspended from the traveling block by means of fluid pressure assemblies which reciprocate to allow the hook to be maintained fixed relative to the undersea floor as the traveling block heaves with the derrick and floating vessel due to wave action for example. Such compensators require the weight of the compensation apparatus to be supported by the same line by which the traveling block is suspended from the crown block, which is fixed to the mast or derrick.

A motion compensator wherein the crown block is intended to remain stationary relative to the undersea floor as the derrick and floating vessel heaves has been designed whereby the crown block is supported from the derrick by means of a pair of direct-acting hydraulic piston-and-cylinder assemblies. Additional compensation apparatus in the form of flexing arms is used in that case to eliminate linear movement of the flexible line supporting the traveling block to prevent relative motion between the traveling block and the crown block as a result of heaving of the derrick.

It is desirable and advantageous to provide a crown block compensator including support assemblies providing balanced support and positioned to minimize the required height of a derrick or mast supporting the crown block and traveling block combination. Similarly, it is desirable to provide like compensation to the line interconnecting the two blocks so that the traveling block and the crown block may remain stationary relative to the undersea floor as the derrick is heaved with the floating vessel. The height of the derrick may be so minimized also by providing a mechanical advantage with the crown block compensator assemblies so that relatively large heaves of the derrick may be compensated with lesser relative movement between the compensator assembly components.

SUMMARY OF THE INVENTION

The present invention provides apparatus for supporting and manipulating objects, and may do so by first and second fluid pressure assemblies each comprising first and second mutually reciprocable bodies urged by fluid pressure in a first directional mode. The first bodies are fixed relative to a first object and the second bodies are connected to a second object whereby proportional, reciprocable motion between the first and second bodies accompanies relative motion between the first and second objects. A third object may be connected to and supported by the second object so that such relative motion between the first and second objects may occur while the third object remains stationary with respect to the second object, but also whereby the third object may be selectively moved relative to the second object regardless of motion between the first and second objects.

In particular embodiments illustrated, the second and third objects are shown as first and second blocks, or a crown block and a traveling block, respectively, with each such block equipped with one or more sheaves about which a flexible line is passed. The first object is illustrated as a derrick or mast, it being understood that the first object may be any type of support structure. The first bodies of the fluid pressure assemblies are fixed relative to the mast while the second bodies carry pulleys about which the flexible line is arrayed toward opposite sides of the first and second blocks. Manipulation of the flexible line relative to the mast, for example, selectively manipulates the second block relative to the first block. The first block is connected to the second bodies carrying the pulleys so that relative motion between the first block and the mast is accompanied by reciprocable motion between the first and second bodies of the fluid pressure assemblies. Such connection between the first block and the second bodies may be by means of flexible lines fixed at one end thereof to the first block and fixed at the other end thereof relative to the first bodies and passing over other pulleys carried by the second bodies.

In another embodiment, the second bodies of the fluid pressure assemblies directly support the crown block. Pulley assemblies are supported by flexible lines between the crown block and the mast so that the pulley assemblies move relative to the mast and the crown block to provide motion compensation for the flexible line connecting the two blocks, which line passes over pulleys carried by the pulley assemblies.

The flexible line arrayed about the sheaves of the first and second blocks may be anchored relative to the mast at one end of the line and arranged to be retracted or payed out relative to the mast toward the other end of the line to so manipulate the second block relative to the first block.

The present invention thus provides apparatus for supporting a crown block, for example, from a mast and a traveling block supported from the crown block wherein the traveling block may be maintained fixed relative to the crown block, or selectively moved relative to the crown block, while the crown block remains stationary relative to a reference as the mast is moved relative to the reference, with proportional movement between reciprocable components of fluid pressure assemblies supporting the two blocks relative to the mast.

BRIEF DESCRIPTION OF THE DRAWINGS

FIG. 8 is an enlarged sectional view, partially broken away, taken along line 8—8 of FIG. 6, showing additional details of the lock bar assembly;

FIG. 9 is a sectional view taken along line 9—9 of FIG. 8 and illustrating details of the lock bar assembly;

DETAILED DESCRIPTION OF PREFERRED EMBODIMENTS

Figure 1:
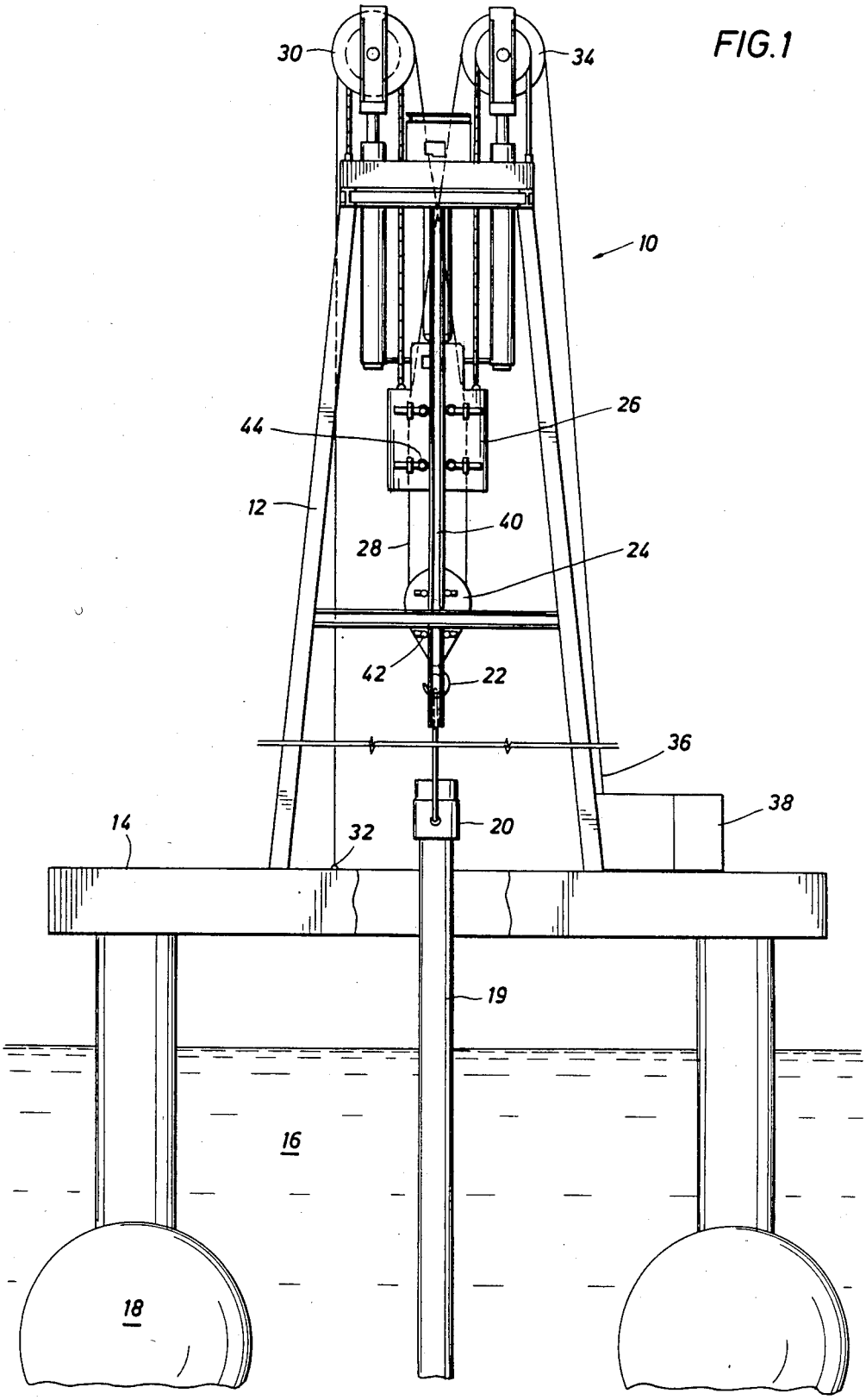
FIG. 1 is a side elevation, in partial section and partly schematic, of a semi-submersible platform with a derrick, or mast, supporting a crown block and a traveling block by means of a compensator according to the present invention.

Compensation apparatus according to the present invention is illustrated generally at 10 in FIG. 1 included in a drilling, or well working, system comprising a derrick, or mast, 12 mounted on a semi-submersible platform 14 supported by flotation devices 18 in a body of water 16. A tubular member 19, which may be a drill string, casing section, or any other equipment, is illustrated supported by an elevator 20 hanging by a hook 22 from a traveling block 24 by which the tubular member may be manipulated and lowered into, or withdrawn from, an underwater well (not shown), for example. During such operations on the well, the platform 14 may heave or otherwise move due to wave action or other such disturbances of the body of water 16. The compensation apparatus 10 accommodates such platform motion while allowing the tubular member 19 to be maintained fixed relative to the underwater floor and well, or to be selectively maneuvered relative to the seabed or well regardless of the heaving motion of the platform 14.

The traveling block 24 is supported from an upper, or crown, block 26 by a flexible working line, or cable, 28 in a manner discussed in detail hereinafter. The line 28 passes over a pulley 30 to one side of the derrick 12 and is fixed at one end 32 of the line relative to the derrick and platform 14. The line 28 also passes over another pulley 34 and, toward the other end of the line at 36, is connected to a drawworks 38 which may be operated to selectively retract, or pay out, the line 28 relative to the drawworks, mast 12 and platform 14. Mounting of the pulleys 30 and 34 is discussed in detail hereinafter.

The derrick 12 includes a vertical track assembly 40 which is engaged by a plurality of rollers 42 and 44 carried by the traveling block 24 and the crown block 26, respectively, whereby the two blocks are guided and constrained during vertical movement of the blocks relative to the derrick.

Figure 2:
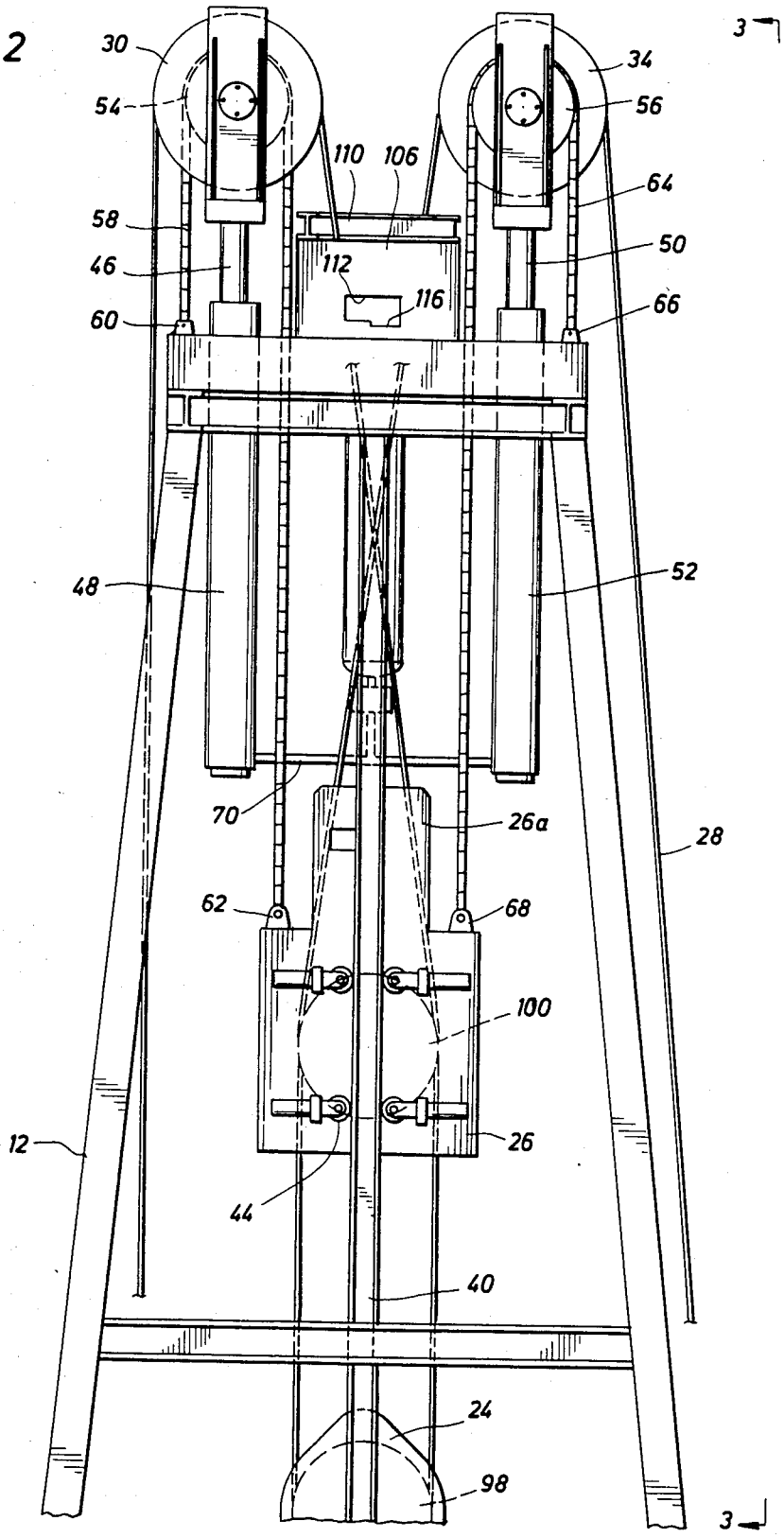
FIG. 2 is an enlarged view of the upper portion of the derrick of FIG. 1 with the derrick raised relative to the blocks.

As indicated in FIG. 2, the pulley 30 is mounted on a horizontally-oriented axle carried by a piston 46 vertically reciprocably movable relative to a cylinder 48 in a fluid pressure assembly. Similarly, the pulley 34 is mounted on a horizontal axle carried by a piston 50 movable relative to a cylinder 52 and providing another fluid pressure assembly. The two cylinders 48 and 52 are mounted fixed relative to the derrick 12 leaving the pistons 46 and 50 movable relative to the derrick.

A pulley assembly 54 is carried by an axle also supported by the piston 46, whereby the pulley 30 is free to rotate relative to the pulley assembly 54. A pulley assembly 56 is similarly carried by the piston 52 with the pulley assembly 56 rotatable relative to the pulley 34. A flexible line, cable or chain assembly, for example, 58 is anchored at one end thereof 60 to the derrick 12, extends over the pulley assembly 54 and is anchored at the opposite line end 62 to the crown block 26. A similar flexible line assembly 64 is anchored at one end thereof 66 to the derrick 12, passes over the pulley assembly 56 and is anchored at the other end of the line 68 to the crown block 26. The two line assemblies 58 and 64 thus support the crown block 26 from the derrick 12 by means of the pulley assemblies 54 and 56, respectively, providing a balanced support on opposite sides of the crown block. It will be appreciated that vertical movement of the pistons 46 and 50 relative to the derrick 12 accompanies vertical movement of the crown block 26 relative to the derrick, with the crown block movement being twice that of the piston movement.

Figure 3:
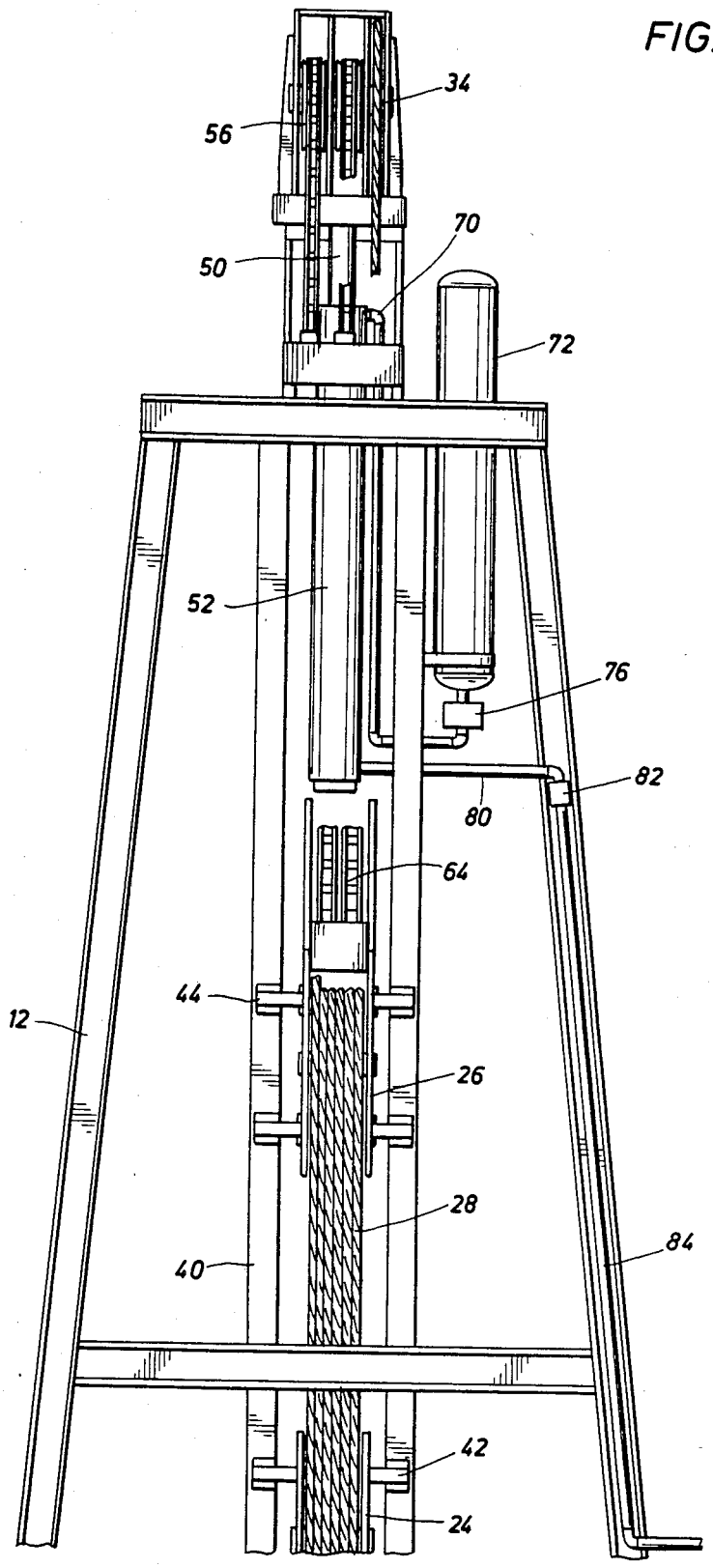
FIG. 3 is a side elevation of the derrick portion illustrated in FIG. 2.
Figure 5:
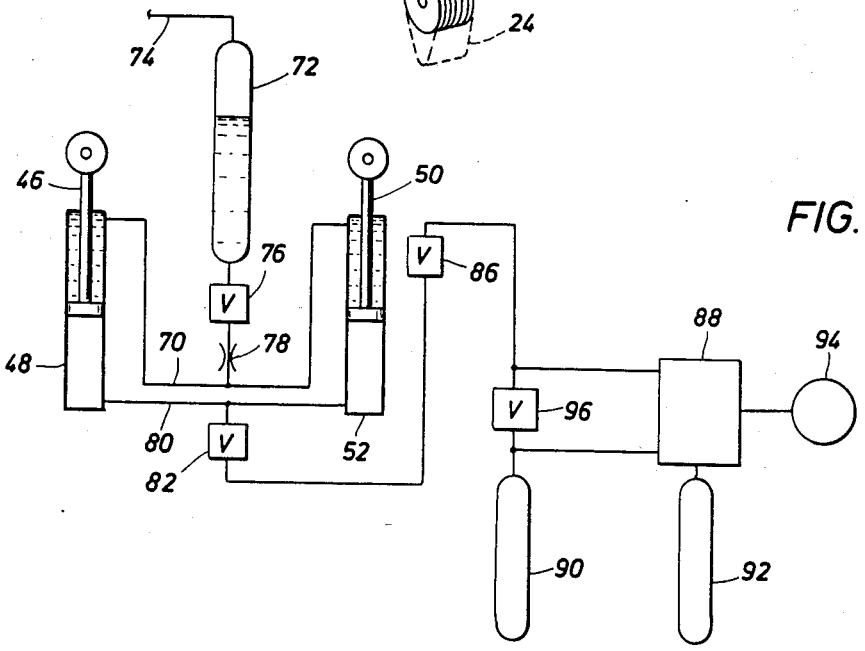
FIG. 5 is a schematic, block diagram of a fluid pressure system utilized to operate the fluid pressure assemblies of the compensator apparatus.

Operation of the pistons 46 and 50 may be further appreciated by reference to FIGS. 3 and 5 wherein it is indicated that the fluid pressure assemblies are partly hydraulic and partly pneumatic. The piston rod sides of the cylinders 48 and 52 are parts of a hydraulic system wherein these cylinder portions are connected by a hydraulic line system 70 to a reservoir 72 containing the hydraulic fluid topped by compressed gas to maintain the liquid under desired pressure. A gas pressure line 74 communicates between the top of the reservoir 72 and a supply (not shown) of the compressed gas. A locking valve 76, including a check valve bypass, is positioned in the hydraulic line between the reservoir 72 and the cylinders 48 and 52. A speed limiting valve (not shown) may be incorporated in the connection of each of the cylinders 48 and 52 with the hydraulic line system 70 to limit the rate of flow of hydraulic fluid between the reservoir 72 and the cylinders, as does an optional orifice indicated at 78, to prevent too rapid upward movement of the pistons 46 and 50 relative to the cylinders.

The fluid pressure cylinders 48 and 52 on the blind sides of the pistons are connected by a high pressure gas line system 80 to a locking valve 82 communicating with a standpipe 84 (FIG. 3) extending downwardly from the elevated position of the cylinders on the derrick to a second valve 86, if necessary. The gas pressure communication system continues to a control console 88 whereby gas pressure may be selectively applied to the cylinders 48 and 52 from one or another of compressed air pressure vessels 90 and 92. An air compressor 94 also communicates with the console 88 for charging the vessels 90 and 92. A valve manifold 96 is available by which one of the air pressure vessels 90 may be communicated to the pistons 48 and 52, bypassing the console 88, if necessary.

Compressed air is provided to the blind sides of the cylinders 48 and 52 to urge the pistons 46 and 50, respectively, in a first directional mode, that is, to extend outwardly from the cylinders and tend to elevate the pulleys carried by the pistons. The hydraulic pressure applied to the rod sides of the cylinders 48 and 52 resists upward movement by the pistons 46 and 50 and provides a cushion against the force applied by the gas pressure on the blind sides of the cylinders.

Figure 4:
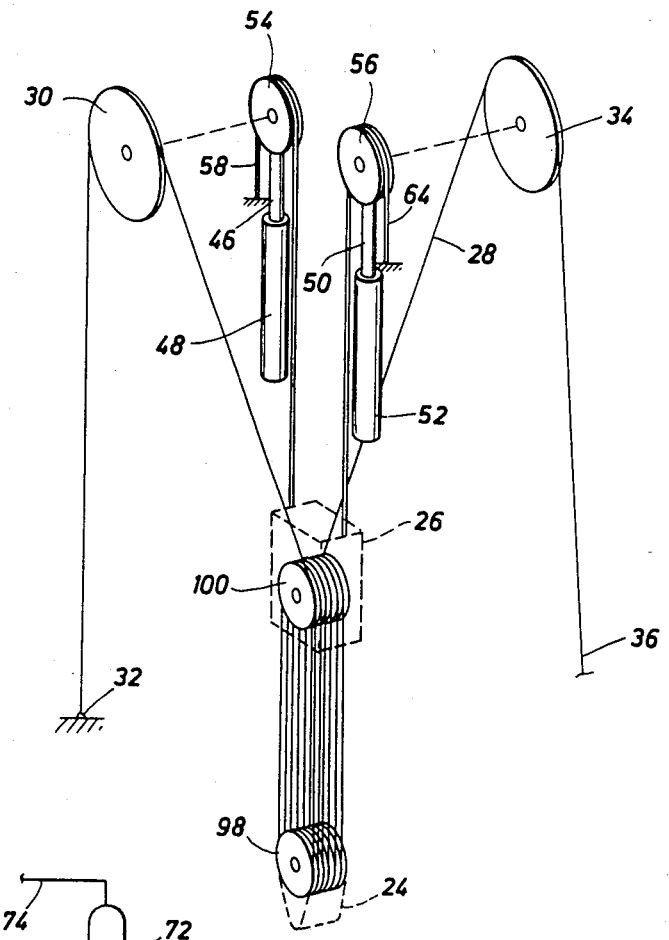
FIG. 4 is a schematic illustration showing various features of the blocks, lines, sheaves and pulleys of the compensator apparatus illustrated in FIGS. 1-3.

As may be appreciated by reference to FIGS. 2, 3 and 4, the traveling block 24 is equipped with a plurality of sheaves 98, the crown block 26 is equipped with a plurality of sheaves 100, and the flexible line 28 is arrayed alternately around the traveling block sheaves and the crown block sheaves between positions along the line wherein the line passes over the pulleys 30 and 34. With one end of the flexible line 28 anchored at 32 to provide a deadline, and the other end of the line 28 at 36 operable by the drawworks 38 as a fast line, the traveling block 24 is suspended from the crown block 26 by the flexible line 28 which thereby supports the traveling block from the derrick 12. Operation of the drawworks 38 to retract or pay out the cable 28 maneuvers the traveling block toward or away from, respectively, the crown block 26.

The crown block 26 is supported by the mast 12 by means of the pistons 46 and 50 supported on air pressure within the cylinders 48 and 52, respectively. With the pneumatic pressure in the cylinders 48 and 52 balancing the load supported by the pistons 46 and 50, respectively, which load includes the two blocks 24 and 26 and equipment supported thereby, such as the tubular member 19 (FIG. 1), downward movement of the cylinders 48 and 52 with the derrick 12 and floating platform 14 tending to lighten the load on the cylinder air supply results in the pistons 46 and 50 moving upwardly relative to the cylinders, maintaining the crown block 26 and all components supported thereby stationary. As the derrick 12 and platform 14 rise with the wave motion, for example, the increased load on the cylinder air supply causes the pistons 46 and 50 to drop downwardly relative to the cylinders 48 and 52, respectively, with the result that the derrick 12 rises relative to the crown block 26 and all components supported thereby.

As the pistons 46 and 50 move upwardly or downwardly within the cylinders 48 and 52, respectively, the hydraulic fluid flows between the rod side of the cylinders and the reservoir 72 as needed to maintain the cylinders full of fluid. Thus, vertical heaving of the derrick 12 relative to the sea floor, for example, is compensated by action of the pistons 46 and 50 relative to the cylinders 48 and 52 whereby the crown block 26 remains stationary relative to the seabed.

Additionally, as the pistons 46 and 50 are moved vertically relative to the heaving derrick, corresponding vertical movement with the pistons of the pulleys 30 and 34 ride the pulleys along the flexible line 28. As the deadline anchor 32 and the drawworks anchor 36 rise relative to the crown block 26, the pulleys 30 and 34 retract toward the cylinders 48 and 52, respectively, maintaining the line 28 stationary at the blocks 24 and 26. Similarly, as the deadline and drawworks anchors 32 and 36, respectively, fall with the derrick fall, the pulleys 30 and 34 extend from the cylinders 48 and 52, respectively, to maintain the line 28 stationary at the blocks 24 and 26. Since the flexible line pulleys 30 and 34 move with the crown block support pulley assemblies 54 and 56, the traveling block 24 remains stationary relative to the crown block 26 as the derrick 12 heaves upwardly and downwardly as long as the drawworks 38 are not operated to retract or pay out the flexible line 28. Further, even with the derrick 12 heaving relative to the crown block 26, the latter remaining stationary with respect to the sea floor, the drawworks 38 may be operated to raise and lower the traveling block 24 relative to the crown block regardless of the vertical movement of the derrick.

As indicated, the flexible line 28 passing over the pulley 30 extends to the far side of the crown block 26 to wrap around the block sheaves 98 and 100 in a clockwise fashion, as viewed in FIG. 2 for example, with the returning line passing over the other pulley 34 and downwardly to the drawworks 38 from the opposite side again of the crown block 26. Thus, all turns experienced by the line 28 going about the pulleys 30 and 34 and the sheaves 98 and 100 are in the same rotational sense, thereby avoiding possible wear effects which might result if the line alternately experienced bends in the opposite rotational sense. The relatively large diameters of the pulleys 30 and 34 also helps to extend the useful life of wire cable or the like, serving as the line 28, for example. Also, with the two pulleys 30 and 34 mutually offset, the crossing of the line 28 between the crown block 26 and the pulleys occurs with the offset spacing the crossed line portions.

The angles which the line 28 makes with the vertical extension of the lines 58 and 64 between the pulley assemblies 54 and 56, respectively, and the crown block 26 are sufficiently small to make negligible any difference in extension in that region of the flexible line 28 compared to the crown block support lines 58 and 64 as the derrick 12 heaves.

The hydraulic locking valve 76 and the pneumatic locking valve 82 may be closed simultaneously (from the control 88, for example) to lock the pistons 46 and 50 at any desired position relative to the cylinders 48 and 52 by preventing flow of fluid relative to the cylinders. The bypass feature of the hydraulic valve 76 permits one-way leakage of liquid into the cylinders 48 and 52 to prevent cavitation as the otherwise locked pistons 46 and 50 settle on the confined gas in the cylinders.

Figure 6:
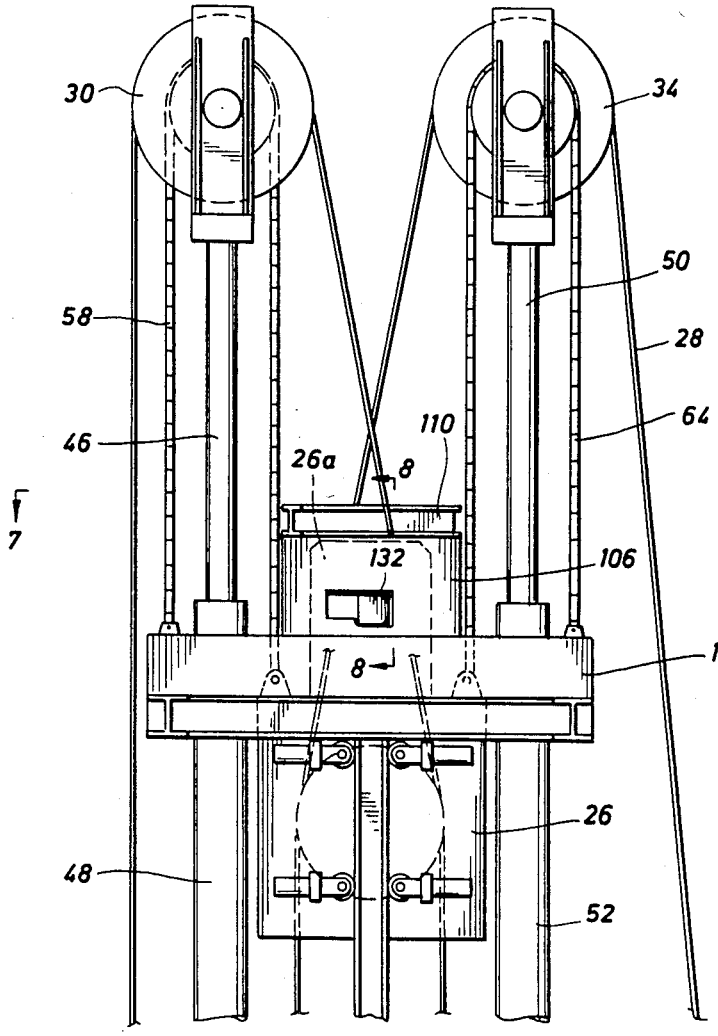
FIG. 6 is a view similar to FIG. 2, but fragmentary and illustrating the pistons of the fluid pressure assemblies extended and the crown block anchored to the derrick by a lock bar assembly.
Figure 7:
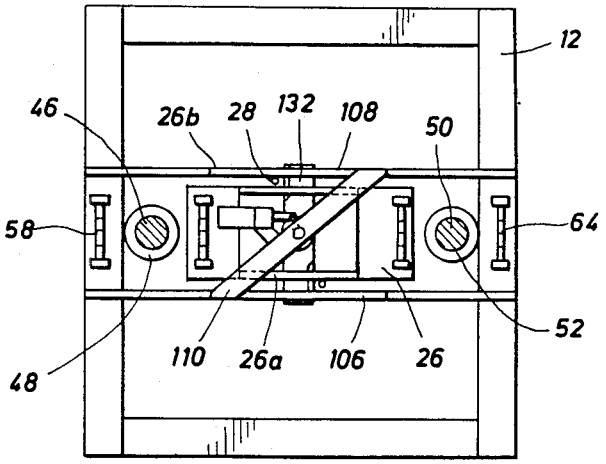
FIG. 7 is a horizontal cross section taken along line 7—7 of FIG. 6, showing details of the lock bar assembly.

The crown block 26 extends upwardly on both sides of the sheave assembly 100 in plates 26*a* and 26*b* (FIG. 8), with the plates exhibiting horizontally-extending holes 102 and 104, respectively. In the raised configuration of the crown block 26 relative to the cylinders 48 and 52 as illustrated in FIGS. 6, 7 and 8, the crown block plates 26*a* and 26*b* pass between vertically oriented plates 106 and 108 as part of the derrick structure. A diagonally-extending beam 110 is supported by the derrick plates 106 and 108. Horizontally-extending holes 112 and 114 are features of the derrick plates 106 and 108, respectively. At least one of the holes 112 and 114 exhibits a depression along the bottom edge thereof, with hole 112 showing a depression 116 in the present illustrations.

A lock bar mechanism, generally along the lines disclosed in U.S. Pat. No. 3,841,770, which is incorporated herein by reference, is supported by the cross beam 110. Details of the locking mechanism, which serves to anchor the crown block 26 to the derrick 12 in the raised configuration of the crown block relative to the cylinders 48 and 52, may be further appreciated by reference to FIGS. 7–9. A shaft 118 passes through an appropriate bore in the cross beam 110 and is held against downward movement relative thereto by nuts 120. Similar nuts 112 threaded to the bottom of the shaft 118 support a generally cylindrical, open-topped housing 124 which encloses a coil spring 126 circumscribing the shaft 118 and covered by a top cap 128. The cap 128 is movable as the spring is compressed or expands. A bushing 130 separates the top cap 128 from a horizontally-extending lock bar 132. The compressed coil spring 126 provides a cushion for limited downward movement of the lock bar 132 relative to the shaft 118 during operation of the locking mechanism.

A flange 134 is rotationally locked to the lock bar 132 by a screw 136 to accommodate the limited vertical movement of the lock bar relative to the shaft 118. A framework 138 is mounted on the shaft 118 by the latter passing through a vertical bore of the framework. An arm 140 extends horizontally as part of the framework 138 and supports a combination of a piston 142 and a cylinder 144. One end of the cylinder 144 is pivotally connected to a bracket 146 extending from the arm 140 and the far end of the piston rod 142 is pivotally pinned to the flange 134 by a pivot joint 138. Application of fluid pressure to the piston-and-cylinder assembly 142/144 to extend to retract the piston relative to the cylinder results in rotation of the flange 134 and, therefore, of the lock bar 132, around the longitudinal axis of the shaft 118.

With the crown block 26 in the raised configuration of FIGS. 6–8, the crown block plate holes 102 and 104 generally align with the derrick plate holes 112 and 114. Then, the piston and cylinder combination 142/144 may be operated to rotate the lock bar 132 to an orientation perpendicular to the plate holes 102, 104, 112 and 114. The lock bar is sized to extend through all four holes as illustrated. Then, the lock bar 132 may support the weight of the crown block 126, and components supported thereby, upon relaxation of pneumatic pressure to the cylinders 48 and 52, if necessary. In such anchored configuration, greater weight may be supported by the crown block 26 than would otherwise be available with the crown block suspended only by the flexible line assemblies 58 and 64 and the pistons 46 and 50.

The vertical extension of the lock bar 132 is less than that of any of the holes 102, 104, 112 and 114 to facilitate movement of the lock bar into and out of the holes. Also, the leading edges of the lock bar 132 passing into the holes are beveled at 132*a* and 132*b* to facilitate engagement of the lock bar within the holes. The bar 132 is also rockably mounted on the shaft 118 by the latter passing through a bore in the bar with the bore diameter slightly larger than the shaft diameter to allow the bar to shift, if necessary, to distribute weight to both derrick plates 106 and 108. At least one hole, such as 112 as illustrated, has a depression 116 which can accommodate the lock bar 132 in its perpendicular configuration relative to the plate 106 whereby the lock bar sitting in the depression would be prevented from being inadvertently rotated out of the holes 102, 104, 112 and 114.

With the weight of the crown block 26 borne by the line assemblies 58 and 64 and the pistons 46 and 50, and the crown block raised sufficiently for the spring 126 to lift the lock bar 132 clear of the hole depression 116, the piston-and-cylinder combination 142/144 may be operated to rotate the lock bar 90° out of the plate holes 102, 104, 112 and 114 to a configuration parallel to the plates 26*a*, 26*b*, 106 and 108. Then, the crown block 26 may be lowered relative to the cylinders 48 and 52 by a controlled relaxation of pneumatic pressure applied thereto to configure the compensation apparatus in operating status. It will be appreciated that the lock bar 132 is clear of the flexible line 28 in the anchoring configuration of FIG. 7, and is also clear of the flexible line 28 in operating configuration of the compensation mechanism wherein the lock bar is oriented perpendicular to the configuration illustrated in FIG. 7.

With the crown block 26 locked to the derrick 12 by the lock bar 132, the traveling block 24 may still be operated to raise and lower loads relative to the crown block by operation of the drawworks 38 to manipulate the line 28 relative to the two blocks 24 and 26. Also, the line pulleys 30 and 34 may be attached to a framework (not shown) extending as part of the derrick 12 to support these pulleys with the crown block anchored to the derrick, whereby the fluid pressure assemblies (46, 48, 50 and 52) may be serviced, disengaged, dismantled, or removed, in whole or in part, while the blocks 24 and 26 are still operational to manipulate loads.

If the fluid pressure assemblies (46, 48, 50 and 52) are incapacitated, the drawworks 138 may be operated to retract the line 28 to raise the traveling block 24 up to the crown block 26. Further retraction of the line 28 lifts both blocks, the traveling block 24 carrying the crown block 26. In this way, the line 28 can be used to raise the crown block 26 to align the crown block plates 26*a* and 26*b* with the derrick plates 106 and 108, whereby the lock bar 132 can be operated to anchor the crown block to the derrick 12 as described hereinbefore.

The motion compensation mechanism of the present invention provides a balanced support for the crown block 26 in that the crown block is suspended from line assemblies 58 and 64 attached at either end of the crown block and passing over pulley assemblies 54 and 56 carried by the pistons 46 and 50 positioned beyond opposite ends of the crown block. Further, the pistons 46 and 50 travel in paths parallel to the line of travel of the crown block 26 relative to the derrick 12 and of the traveling block 24 relative to the crown block and to the derrick. The support of the flexible line 28, which interengages the traveling block 24 with the crown block 26, by the pulleys 30 and 34 carried by the same pistons 46 and 50 which support the crown block 26, allows for relative movement between the traveling block and the derrick in the same action which allows for relative movement between the crown block and the derrick to compensate for movement of the derrick relative to the referenced seabed. Thus, no additional compensation mechanism is required to allow the traveling block 24 to be maintained fixed, or selectively moved, relative to the crown block 26 as the derrick 12 is heaved relative to the seabed. The compensation system may also be utilized to provide a cushioned, or soft, landing for equipment lowered by the blocks without movement of the derrick. It will be appreciated that construction of the cylinders 48 and 52 whereby the crown block 26 may be raised between the cylinders does not require undesirable upward extension of the derrick 12.

Figure 10:
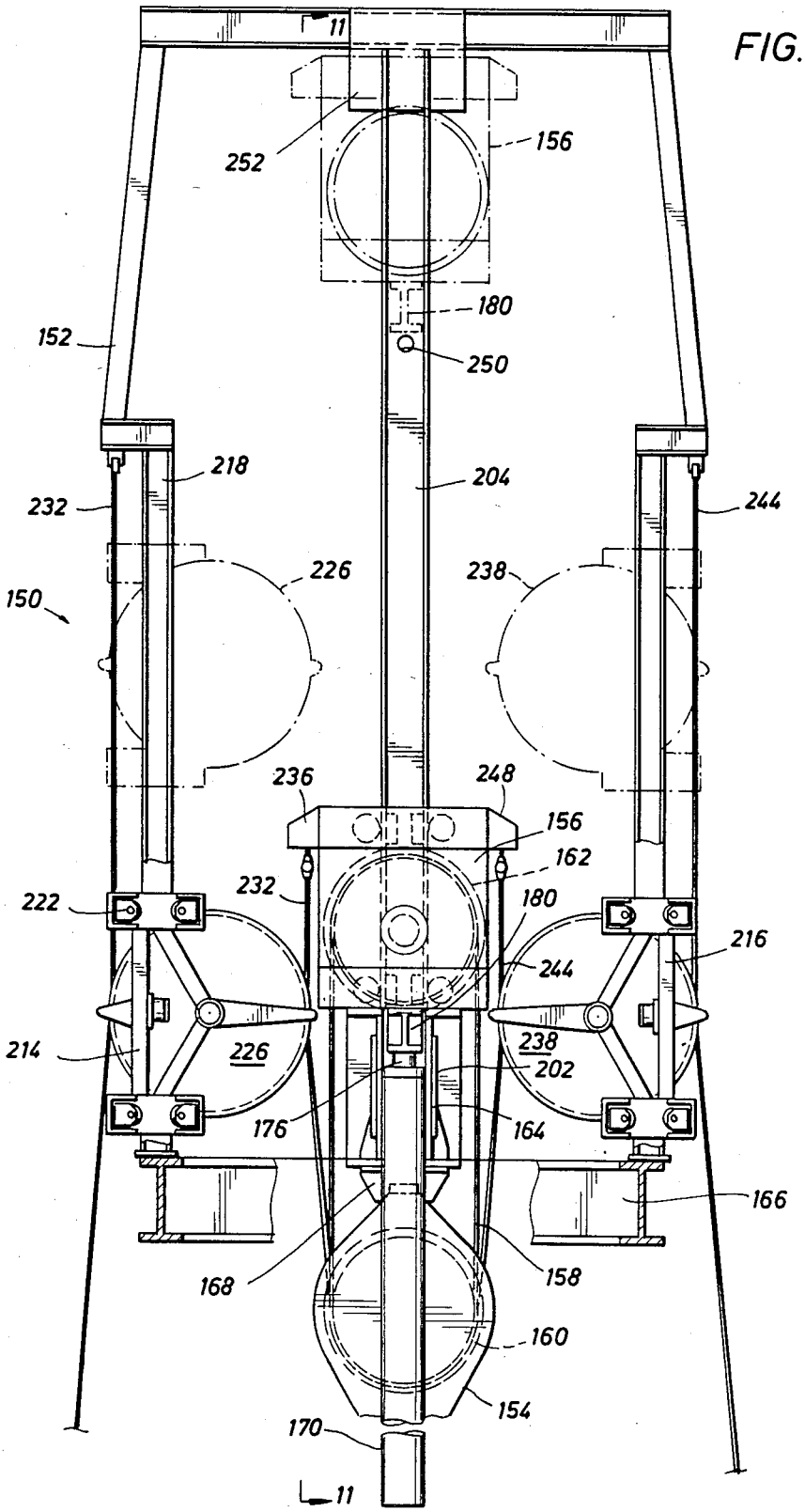
FIG. 10 is a side elevation, partially broken away, of the upper portion of a derrick, or mast, supporting a crown block and a traveling block by means of another version of a compensator according to the present invention, with the crown block shown generally in its lowest position relative to the derrick; in phantom, the crown block is shown generally at its highest position relative to the derrick, and the compensator pulley assemblies are shown at their respective elevated positions.
Figure 11:
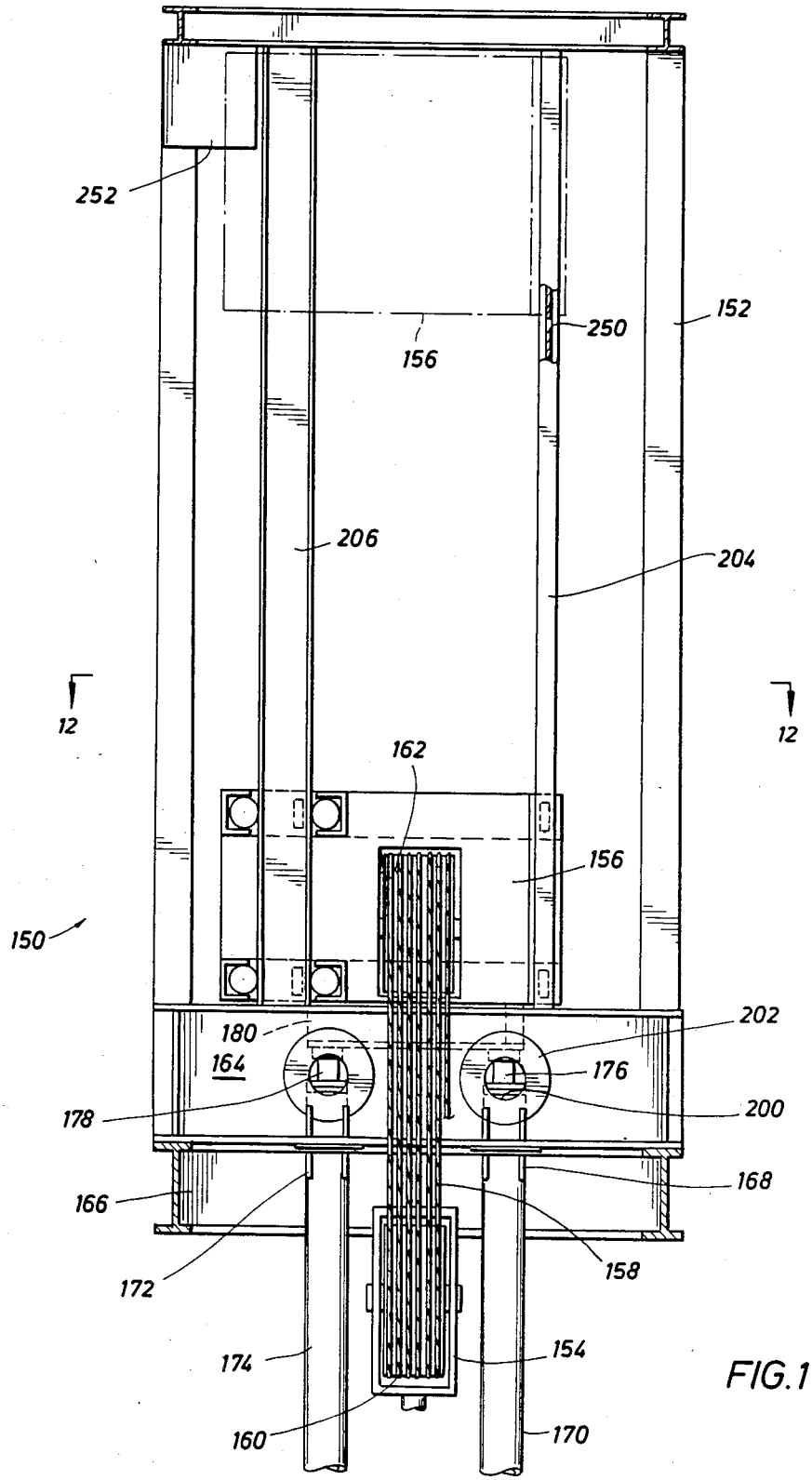
FIG. 11 is a vertical cross section taken along line 11—11 of FIG. 10.

Another version of compensation apparatus according to the present invention is illustrated generally at 150 in FIGS. 10 and 11 included in a drilling, or well working, system comprising a derrick, or mast, 152 mounted on a floating platform (not shown) generally as illustrated in FIG. 1. A traveling block 154, from which equipment to be manipulated may be supported, is in turn suspended from a crown block 156 by a flexible working line, or cable, 158. The traveling block 154 is equipped with a plurality of sheaves 160, and the crown block 156 is equipped with a plurality of sheaves 162. The flexible line 158 is arrayed alternately around the traveling block sheaves 160 and the crown block sheaves 162 whereby the traveling block 154 is supported by the crown block 156 and is moveable relative thereto by manipulation of the flexible line 158.

Figure 12:
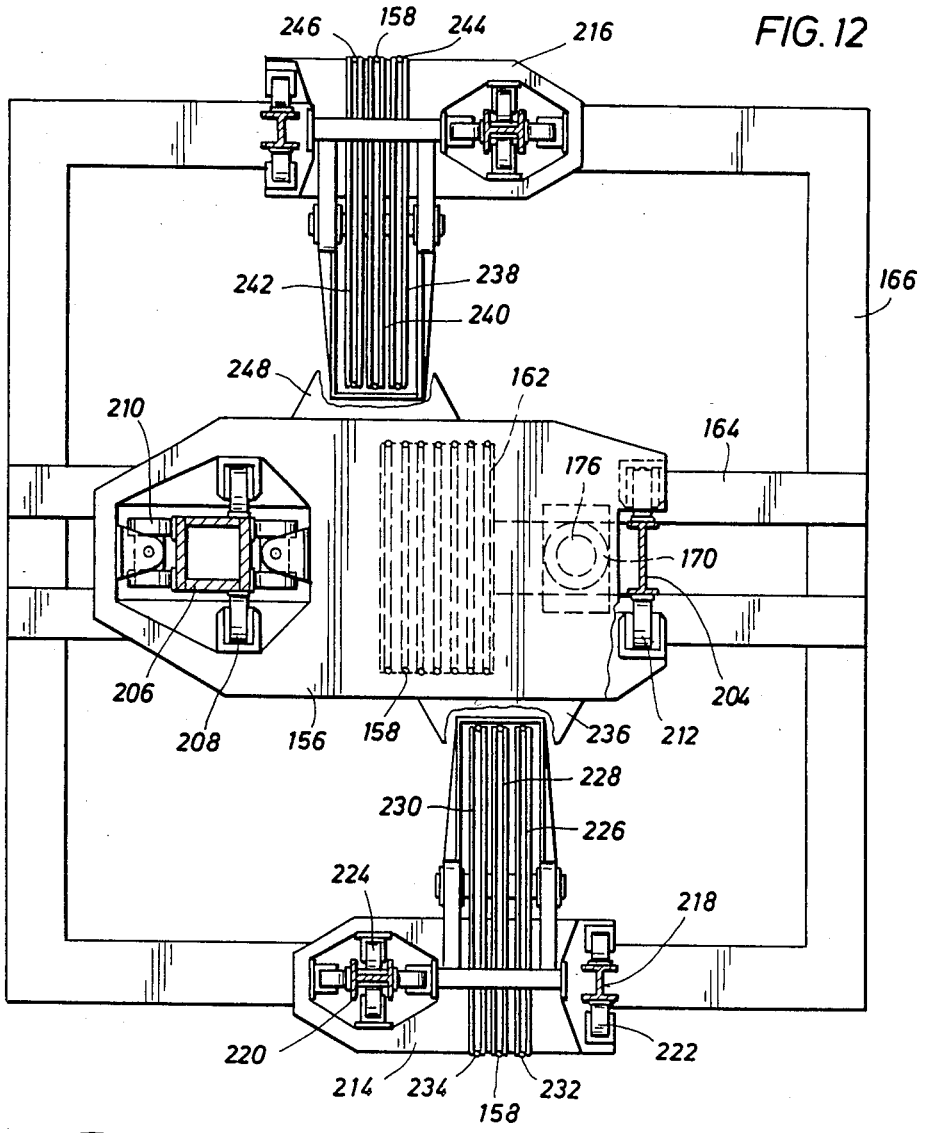
FIG. 12 is an enlarged horizontal cross section taken along line 12—12 of FIG. 11, showing details of the crown block and of the pulley assemblies.

As may be appreciated by reference to FIGS. 10–12, a pair of parallel, spaced beams 164 is supported by horizontally-oriented cross members 166 of the derrick 152. Brackets 168 are fitted to a fluid pressure cylinder 170 and bolted to the beams 164 to join the cylinder to the beams. Similarly, as may be appreciated by reference to FIG. 11, similar brackets 172 are bolted to the beams 164 to join a second fluid pressure cylinder 174 to the beams. The cylinders 170 and 174 are positioned on opposite sides of the path of travel of the two blocks 154 and 156, and parallel thereto, that is, the cylinders are vertically-oriented. The cylinders 170 and 174 are fitted with reciprocably movable pistons 176 and 178, respectively, which consequently are so movable parallel to and on opposite sides of the path of travel of the two blocks 154 and 156.

The crown block 156 is constructed to include a housing structure which supports the sheaves 162, and features a horizontally-oriented beam 180 extending downwardly from the housing proper as illustrated in FIGS. 10 and 11. With the crown block 156 in its lowermost position as shown in FIGS. 10 and 11, the crown block beam 180 is received in the spacing between the pair of beams 164. Each of the piston rods 176 and 178 is joined to the crown block beam 180. Details of the union between the piston rods and the crown block beam 180 may be appreciated by reference to FIG. 13, wherein such union is illustrated for one piston rod 178, it being understood that the union provided between the second piston rod 176 and the beam is essentially the same.

Figure 13:
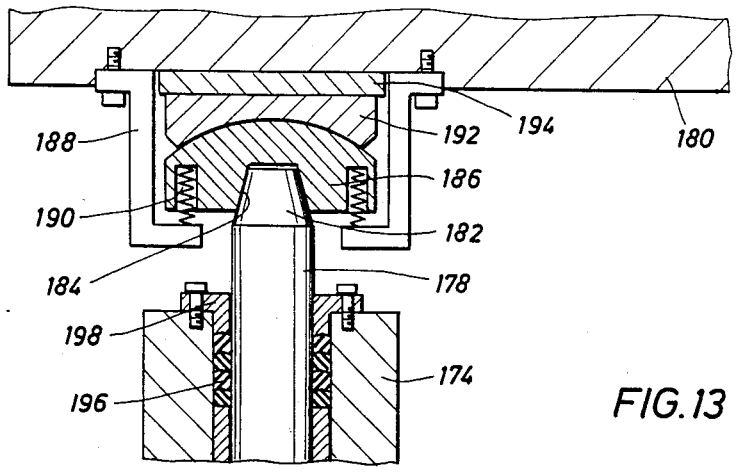
FIG. 13 is an enlarged, fragmentary side elevation of the top of a piston rod, illustrating the manner in which the crown block is supported by the piston rods.

The top end of the piston rod 178 provides a frustoconical surface 182, which may be received within a generally complementary recess 184 on the underside of a cap 186. The cap 186, having a curved top surface, is held within a bracket 188 bolted to the underside of the crown block beam 180, a plurality of spring members 190 being received within appropriate bores in the cap and being compressed therebetween and the lower, interior surface of the bracket. Consequently, the cap 186 is urged upwardly toward the beam 180 by the springs 190, which generally serve to maintain the cap oriented as illustrated in FIG. 13 when the piston rod 178 is removed from contact with the cap. A socket 192 featuring a curved undersurface complementary to the curved top surface of the cap 186, overlies and receives the cap, and serves as a bearing between the cap and a top plate 194. Both the top plate 194 and the bearing socket 192 may be constructed of relatively low friction metal alloys. With the piston rods 178 supporting the crown block 156, the junctions between the piston rods and the crown block beam 180 as illustrated in FIG. 13 permit sufficient relative movement between the piston rods and the crown block, both horizontally as between the crown block beam 180 and the top plate 194 as well as the socket bearing 192, and rotationally as between the curved surfaces of the bearing socket 192 and the cap 186, to relieve any lateral moments that may be otherwise imposed on the piston rods by such engagement with and support of the crown block 156.

FIG. 13 also illustrates the top of the corresponding fluid pressure cylinder 174, which is closed against the piston rod 178 by an appropriate seal assembly, including packing glands 196, which are further held in place by a closing plate 198 bolted to the end of the cylinder.

The support beams 164 are each equipped with access holes 200 whereby the cylinders may be serviced, for example. Annular plates 202 are added to the support beams 164 to encircle the access holes 200 and provide compensating strength to the beams around the holes.

The fluid pressure assemblies provided by the pistons 176 and 178 and cylinders 170 and 174, respectively, may be partly hydraulic and partly pneumatic, and operated by a fluid pressure system constructed and operated generally as illustrated in FIG. 5, for example. Details of such a fluid pressure system are omitted from FIGS. 10–12 illustrating the compensation apparatus at 150 for purposes of clarity, but may be understood to be utilized, in one appropriate form or another, to so operate the apparatus.

Pressure is applied to the cylinders 170 and 174 to raise the pistons 176 and 178 to place the compensation apparatus in operable configuration, that is, with the crown block 156 supported by the pistons above the suppport beams 164 and able to remain stationary relative to the underwater floor as the derrick 152 is heaved, with sufficient room along the piston stroke to allow for relative movement between the pistons and the derrick during such heaving motion. The upper limit of the piston stroke is indicated in FIGS. 10 and 11 by the position of the crown block 156 shown in phantom at the top of the piston stroke. As the derrick 152 heaves with its support platform, for example, due to wave action or otherwise, the fluid pressure system responds as discussed hereinbefore with resultant reciprocable movement of the pistons 176 and 178 relative to the corresponding cylinders 170 and 174, and, therefore, relative to the derrick 152 and its support platform, but maintaining the pistons and the crown block 156 supported by the pistons fixed, or stationary, relative to the reference underwater floor.

As may be particularly appreciated by reference to FIG. 12, a pair of guide beams 204 and 206 extend from the support beams 164 upwardly toward the top of the derrick 152. The guide beams 204 and 206 serve as tracks along which the crown block 156 is moved by operation of the pistons 176 and 178. The main guide beam 206 is shown as a box beam, and opposed rollers 208 carried on horizontal axles by the crown block 156 ride on the sides of the box beam. A plurality of opposed rollers 210 mounted on horizontal axles which are in turn carried in mountings pivotal on vertical axles ride on the remaining two opposed sides of the box beam 206. A plurality of opposed rollers 212, mounted on horizontal axles carried by the crown block 156, ride on opposite surfaces of the secondary guide beam 204, which is shown in the form of an I beam. The flexible-type mounting of the fore-and-aft rollers 210 riding on the box beam 206 accommodates any discrepancies in the desired mutually parallel arrangement of the two guide beams 204 and 206, such as bending, twisting or other misalignment of one or both of the beams.

Two pulley assemblies 214 and 216, respectively, are positioned on the derrick 152 on opposite sides of the crown block 156, as viewed in FIG. 10. The pulley assemblies 214 and 216 are generally constructed and function alike. Each pulley assembly 214 and 216 is movable along a pair of corresponding guide beams 218 and 220, shown as I beams. A plurality of rollers 222 are carried on horizontal axles to ride along opposite surfaces of the forward guide beam 218. The rearward guide beam 220 is surrounded by a plurality of rollers 224, all mounted on horizontal axles, and riding on opposite surfaces of the rearward I beam. The guide beams 218 and 220 extend from the level of approximately the support beams 164 upwardly a distance, along the derrick 152, which is at least one-half the distance of the stroke of the pistons 176 and 178 and, therefore, the permitted movement of the crown block 156.

The pulley assembly 214 carries three pulleys of equal diameter, 226, 228 and 230, positioned on a horizontal axle but independently rotatable about the axle. A pair of flexible lines, such as cables, chains or the like, 232 and 234 are anchored on the derrick 152 near the top ends of the guide beams 218 and 220, and extend down to wrap around the undersides of the outer pulleys 226 and 230, respectively, and continue upwardly to be anchored to the underside of an overhang 236 positioned toward the top of the crown block 156. Similarly, the pulley assembly 216 carries three pulleys of like diameter, 238, 240 and 242, mounted on a horizontal axis but independently rotatable about the axis. A pair of flexible lines, such as cables, chains or the like, 244 and 246, are similarly anchored to the derrick 152, extend downwardly to wrap around the outer pulleys 238 and 242, respectively, and continue upwardly to be anchored to the underside of an extension carried toward the top of the crown block 156. As the crown block 156 experiences relative movement along the guide beams 204 and 206, that is, as the pistons 176 and 178 respond to vertical heaving of the derrick 152 to maintain the crown block fixed relative to the seabed as the derrick moves relative to the crown block, the lines 232, 234, 244 and 246 support the pulley assemblies 214 and 216, causing the pulley assemblies to experience relative movement with respect to the derrick 152 as the derrick is moved relative to the crown block 156. It will be appreciated, however, that the movement experienced by the pulley assemblies 214 and 216 relative to the derrick 152 will always be one-half of the movement experienced by the crown block 156 relative to the derrick. Thus, if the derrick 152 moves so that the crown block 156 is carried by the pistons 176 and 178 along the guide beams 204 and 206 a distance of four meters, for example, the pulley assemblies 214 and 216 will experience movement along their respective guide beams of only two meters.

The flexible working line 158 which connects the traveling block 154 to the crown block 156 extends upwardly from the traveling block, passes over the central pulley 240 of the pulley assembly 216 and extends downwardly therefrom to be anchored to the derrick 152 or its supporting platform as a deadline. Toward its opposite end, the working line 158 extends upwardly from the traveling block 154 to pass over the central pulley 228 of the pulley assembly 214 and downward therefrom to a drawworks (not shown) as described hereinbefore. Retraction or paying out of the working line 158 by operation of the drawworks results in raising or lowering, respectively, of the traveling block 154 relative to the crown block 156. The two pulleys 228 and 240 which support the working line 158 rise and fall relative to the derrick 152 with the pulley assemblies 214 and 216 in conjunction with relative movement between the derrick and the crown block 156. Since each pulley assembly 214 and 216 moves one-half the distance moved by the crown block 156, relative to the derrick 152, the traveling block 154 will remain stationary relative to the crown block 156 as the derrick 152 heaves, or will rise and fall relative to the crown block due solely to the operation of the drawworks to retract or pay out the working line, respectively. Consequently, the compensating apparatus illustrated in FIGS. 10–13 not only maintains the crown block 156 stationary relative to the reference seabed as the derrick 152 is moved vertically by wave action, for example, but also provides that the traveling block 154 is mainpulated to rise and fall, or remain stationary, relative to the crown block 156 by operation only of the drawworks regardless of such vertical movement of the derrick.

The crown block 156 may be raised to its maximum height, as indicated in phantom in FIGS. 10 and 11, for example, and there anchored to the derrick 152 by any appropriate means. For example, a throughbore 250 may be provided in the secondary guide beam 204 so that, with the crown block 156 at its maximum location as indicated, a pin or other such device may be inserted and locked in position within the bore below the crown block beam 180, whereby the pin or other such device is so structured as to underlie the beam 180 or other crown block structure. Thereafter, the pistons 176 and 178 may be lowered, for example, and serviced as needed. A similar locking arrangement may be provided on the main guide beam 206. Further, the crown block 156 may be so anchored to the top of the derrick 152 to be utilized in a non-compensating configuration, just as the crown block may be positioned and so used with the pistons fully retracted, as shown in FIGS. 10 and 11, and even with the crown block resting on the support beams 164 to remove the crown block load from the fluid pressure systems including the cylinders 170 and 174.

A locking bar assembly or other appropriate device may be utilized in place of the pin as described to anchor the crown block 156 at the top of the derrick 152. Such other anchoring devices are indicated schematically by 252 in FIGS. 10 and 11.

With the pistons 176 and 178 acting directly on the crown block 156, the possibility of lateral forces acting on the piston rods should be minimized. The connection of the pistons 176 and 178 to the crown block 156 allowing lateral slippage therebetween, as illustrated in FIG. 13, further acts to minimize, or eliminate, lateral forces transmitted to the pistons by way of the crown block.

The compensation apparatus 150 provides a balanced support for the crown block 156, and compensation for the working line 158 as well. Further, the apparatus may be utilized to provide soft, or cushioned, landings for loads with the derrick 152 stationary.

Figure 14:
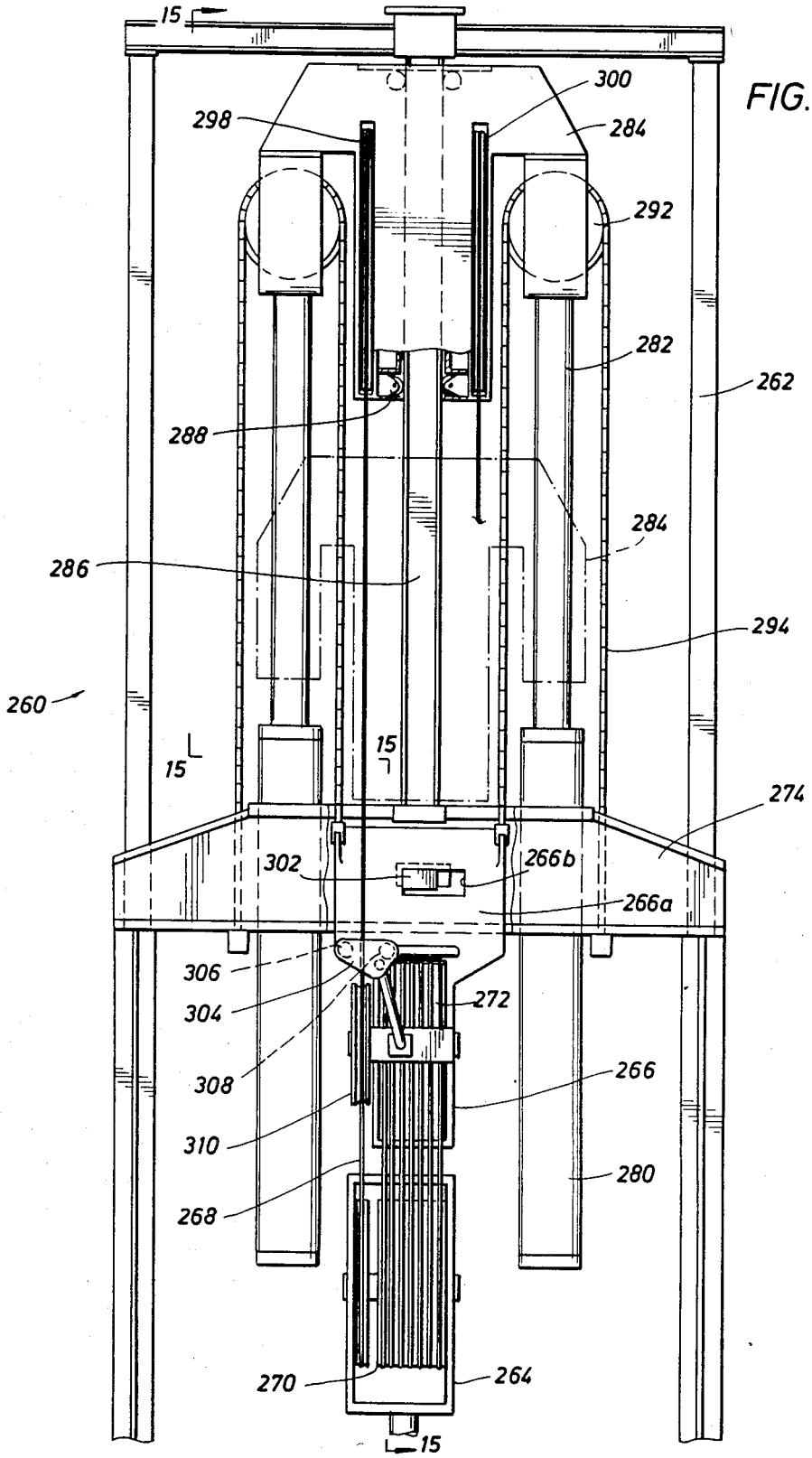
FIG. 14 is a side elevation of the upper portion of a derrick, or mast, supporting a crown block and a traveling block by means of yet another version of a compensator according to the present invention, partially broken away to show the crown block locked by a lock bar assembly in generally the uppermost position of the crown block relative to the derrick; the pulley assembly is shown, in phantom, in generally its lowermost configuration.
Figure 15:
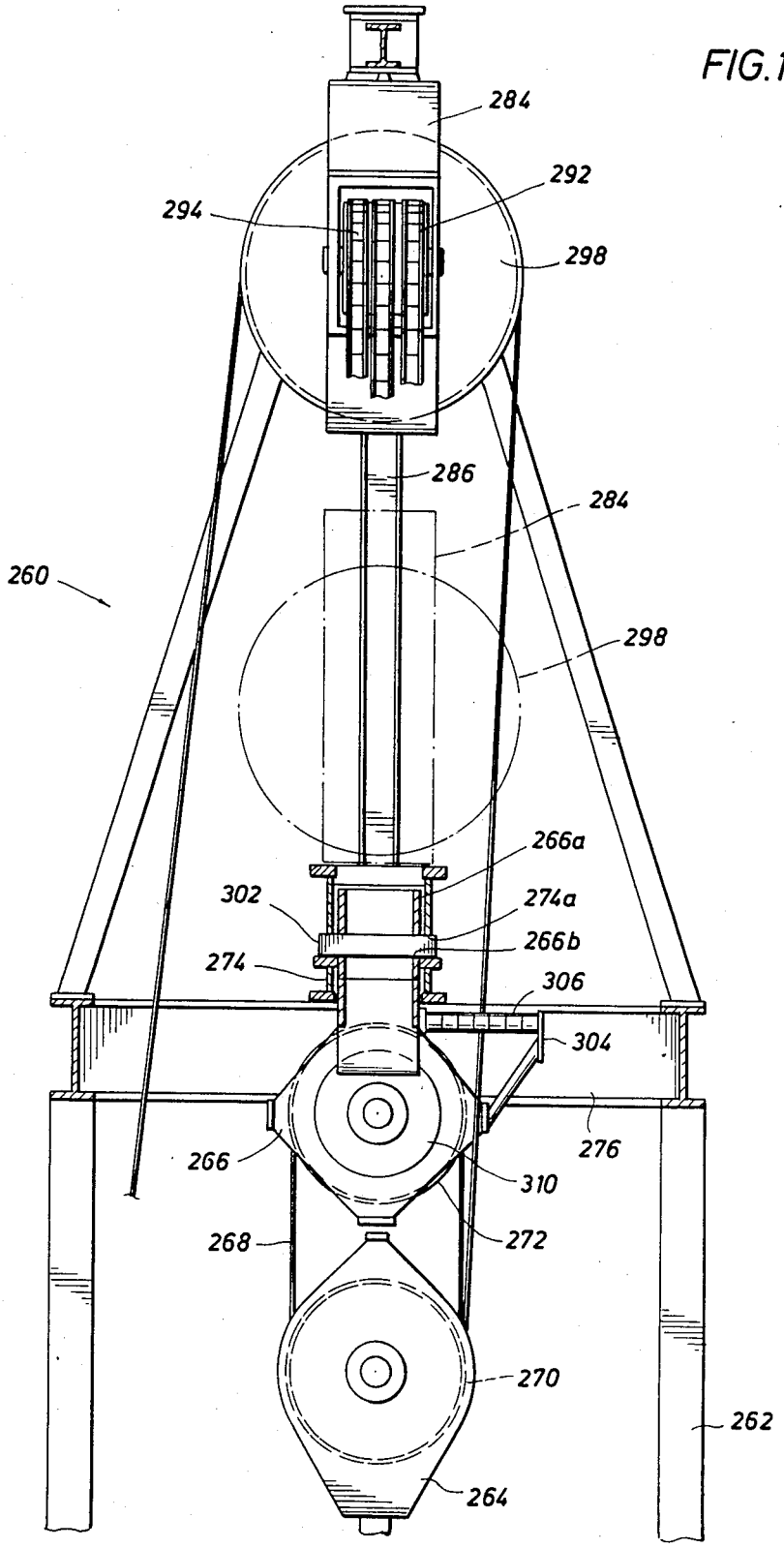
FIG. 15 is a vertical cross section taken along the line 15—15 of FIG. 14.

Yet another version of compensation apparatus according to the present invention is illustrated generally at 260 in FIGS. 14 and 15 included in a drilling, or well working, system, comprising a derrick, or mast, 262 mounted on a floating platform (not shown) generally as illustrated in FIG. 1. A traveling block 264, from which equipment to be manipulated may be supported, is in turn suspended from a crown block 266 by a flexible working line, or cable, 268. The traveling block 264 is equipped with a plurality of sheaves 270, and the crown block 266 is equipped with a plurality of sheaves 272. The flexible line 268 is arrayed alternately around the traveling block sheaves 270 and the crown block sheaves 272 whereby the traveling block is supported by the crown block and is movable relative thereto by manipulation of the flexible line.

Figure 16:
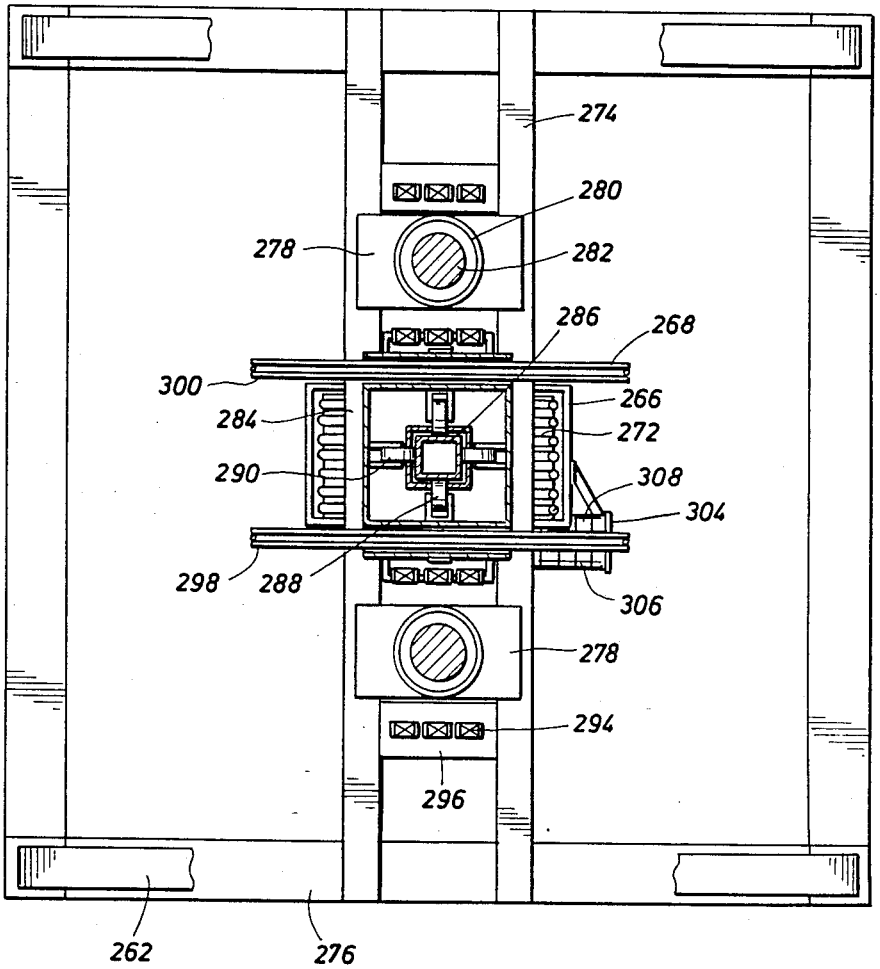
FIG. 16 is an enlarged plan view, partially broken away and in partial section, of the compensator apparatus illustrated in FIG. 15.

As may be appreciated by reference to FIGS. 14–16, a pair of parallel, spaced beams 274 is supported by horizontally-oriented cross members 276 of the derrick 262 and are connected by two members 278. Two fluid pressure cylinders 280, each fitted with a corresponding piston 282, are supported by the members 278 and configured to be parallel to and on opposite sides of the path of travel of the crown block 266 and of the traveling block 264. A carriage 284 is supported by both of the pistons 282, and may be mounted thereon by a laterally-yielding connection of the type illustrated in FIG. 13, for example, to minimize transmittal of lateral force and whereby the carriage may be selectively anchored at the top of the derrick 262 and the pistons retracted for servicing, for example. A guide beam 286, in the form of a box beam, extends from the cross beams 274, which support the guide beam, to the top of the derrick 262. The carriage 284 generally circumscribes the guide beam and carries a plurality of opposed rollers 288 mounted on horizontal axes to ride along the sides of the guide beam 286 (as viewed in FIG. 14) and a plurality of opposed rollers also mounted on horizontal axles to ride on the front and back of the guide beam, whereby the carriage is constrained to a longitudinal path.

The fluid pressure assemblies provided by the pistons 282 and cylinders 280 may be partly hydraulic and partly pneumatic, and operated by a fluid pressure system constructed and operated generally as illustrated in FIG. 5, for example. Details of such a fluid pressure system are omitted from FIGS. 14–16 illustrating the compensation apparatus at 260 for purposes of clarity, but may be understood to be utilized, in one appropriate form or another, to so operate the apparatus.

The pistons 280 are illustrated in FIGS. 14 and 15 at the top of their stroke, with the carriage 284 raised toward the top of the derrick 262. The carriage 284 is also illustrated in FIGS. 14 and 15 in phantom at the lower extent of its path of travel, with the pistons 282 retracted.

The carriage 284 carries a plurality of pulleys 292 on each side of the carriage, with the pulleys positioned generally over the corresponding pistons 282. A like number of flexible lines, such as chains or cables, 294 are wrapped over the pulleys 292, and extend downwardly outside the pair of pistons 282 to anchoring points on cross members 296 connected to the support beams 274 to anchor one end of each line to the derrick 262. Toward their opposite ends, the lines 294 extend downwardly from the pulleys 292 between the pistons 282 and are anchored to the crown block 266. Thus, as the pistons 282 are manipulated to rise and fall relative to the cylinders 280, the carriage 284 rises and falls accordingly along the guide beam 286 and raises or lowers the crown block 266 by means of the flexible lines 294. Further, the distance traveled by the crown block 266 is twice that traveled by the pistons 282 and carriage 284, relative to the derrick 262.

The carriage 284 also carries two pulleys 298 and 300, independently rotatable on horizontal axles oriented laterally as viewed in FIG. 14. The flexible working line 268 extends upwardly from the traveling block 264 to pass over one pulley 300 and extend downwardly to be anchored to the derrick 262 or its supporting platform as a deadline. Toward its opposite end, the working line 268 extends upwardly from the traveling block 264 to pass over the other pulley 298 and downwardly therefrom to a drawworks (not shown) as described hereinbefore. Retraction or paying out of the working line 268 by operation of the drawworks results in raising or lowering, respectively, the traveling block 264 relative to the crown block 266. The two working line pulleys 298 and 300 rise and fall, relative to the derrick 262, as the carriage 284 is raised or lowered by operation of the pistons 282.

It will be appreciated that, with the pistons 282 extended to place the carriage 284 at its highest position, as illustrated in FIGS. 14 and 15, the crown block 266 is shown raised to its highest point of travel along the derrick 262. The crown block features a pair of upwardly-extending plates **266*a* which have horizontally-extending holes 266*b*. As the crown block 266 is thus positioned at its highest point, its plates 226*a* extend upwardly between the support beams 274, and generally align the holes 266*b* with elongate, horizontally-extending holes 274*a* in the support beams. A lock bar 302 may be operated to reside within the crown block holes 266*b* and the support beam holes 274*a* to anchor the crown block 266 to the support beams. Apparatus for manipulating the lock bar 302 is not shown on FIGS. 14 and 15 for purposes of clarity, but it will be appreciated that the lock bar 302 may be operated by an assembly whose construction and operation is similar to that illustrated in FIGS. 7–9 and discussed in relation thereto hereinbefore. With the crown block 266 anchored to the support beams 274 by the lock bar 302, the crown block and traveling block 264 may be utilized without compensation, by operation of the drawworks to pay out or retract the working line 268. In the event of failure of the fluid pressure assemblies, or the system used to operate them, the traveling block 264 may be raised by operation of the drawworks to retract the working line 268, whereby the traveling block may engage and lift the crown block 266 into position to be anchored by the lock bar 302**.

The apparatus may be placed in a compensating configuration with the crown block 266 disengaged from the lock bar 302 and the pistons 282 positioned other than at the ends of their stroke. Then, as the derrick 262 is heaved vertically upwardly or downwardly due to wave action, for example, the fluid pressure system operating the pistons 282 and cylinders 280 responds as discussed hereinbefore to extend the pistons relative to the cylinders as the derrick falls, and to produce retraction of the pistons as the derrick rises. Consequently, the crown block 266 remains stationary relative to the reference seabed, for example. Similarly, the movement of the derrick 262 relative to the seabed is compensated for in the matter of the working line 268 by movement of the working line pulleys 298 and 300 with the pistons 282. The traveling block 264 therefore remains stationary relative to the crown block 266 as the derrick heaves, or the traveling block is manipulated relative to the crown block by operation of the drawworks (not shown) regardless of such movement of the derrick relative to the seabed.

A bracket 304 extends from and is carried by the crown block 266 to support two parallel rollers 306 and 308, the bracket and rollers constraining the working line 268 extending from the pulley 298 to the traveling block 264 in the event that the traveling block is pulled back (as viewed in FIG. 14), for example. A freely rotating sheave 310 is carried on the side of the crown block 266 to constrain the working line 268 in the event the traveling block 264 is pulled forward (as viewed in FIG. 14).

The compensating apparatus at 260 illustrated in FIGS. 14–16 minimizes, or eliminates, any lateral moments that might tend to operate on the pistons 282 due to downward forces transmitted thereto by means of the support lines 294 and/or the working line 268, since the carriage 284 links the pistons 282 together. Additionally, as noted hereinbefore, the connection between the pistons 282 and the carriage 284 may be by means of a connection as illustrated in FIG. 13, for example, to minimize such lateral forces.

The compensation apparatus 260 provides a balanced support for the crown block 266, and compensation for the working line 268 as well. Further, the apparatus may be utilized to provide soft, or cushioned, landings for loads with the derrick 262 stationary.

The foregoing disclosure and description of the invention is illustrative and explanatory thereof, and various changes in the size, shape and materials as well as in the details of the illustrated construction may be made within the scope of the appended claims without departing from the spirit of the invention.

What is claimed is:

1. Apparatus for supporting and manipulating objects comprising:

a. first and second blocks, each equipped with one or more sheaves for mutual engagement of said blocks by a flexible line whereby said second block may be supported from said first block and selectively moved with respect thereto by means of said line so that objects supported by said second block may be so manipulated relative to said first block;

b. first and second fluid pressure assemblies, each such assembly comprising first and second reciprocable bodies, and fluid pressure means for applying fluid pressure to said fluid pressure assemblies to urge said reciprocable bodies in a first directional mode, said first and second assemblies being positioned on opposite sides of, and generally parallel to, a line of movement of said second block relative to said first block with said first directional mode generally parallel to said direction of movement;

c. means connecting said first block to said second bodies whereby movement of said first block relative to said first bodies is accompanied by proportional reciprocable motion between said respective first and second bodies; and d. pulleys mounted on assembly means, and flexible line means for supporting said assembly means to effect movement thereof proportional to movement of said first block relative to said first bodies, with said flexible line arrayed about each said pulley and such that said line thus supports said second block from said pulleys.

2. Apparatus as defined in claim 1 further comprising means associated with said first and second bodies for applying fluid pressure to said first and second bodies to resist reciprocation of said bodies in said first directional mode while permitting such reciprocation.

3. Apparatus as defined in claim 1 wherein said first and second fluid pressure assemblies comprise fluid pressure piston-and-cylinder assemblies which are arranged in parallel on opposite sides of said line of movement of said second block relative to said first block.

4. Apparatus as defined in claim 1 further comprising means for selectively manipulating said flexible line relative to said first bodies for selectively manipulating said second block relative to said first block.

5. Apparatus as defined in claim 1 further comprising means for selectively anchoring said first block relative to said first bodies.

6. Apparatus as defined in claim 1 wherein said first bodies may move relative to a reference while said first block remains stationary relative to said reference and said second bodies move proportionately relative to said first bodies.

7. Apparatus as defined in claim 1 wherein said pulleys are carried by said second bodies.

8. Apparatus as defined in claim 1 further comprising second fluid pressure means associated with said first and second bodies for applying fluid pressure to said first and second bodies to resist reciprocation of said bodies in said first directional mode while permitting such reciprocation.

9. Apparatus as defined in claim 1:

a. wherein one end of said flexible line is fixed relative to said first bodies; and b. further comprising means for selectively retracting or paying out said flexible line toward the opposite end thereof relative to said first bodies for selectively manipulating said second block relative to said first block.

10. Apparatus as defined in claim 1 further comprising fluid locking valve means for selectively locking said second body relative to said first body of each of said fluid pressure assemblies by preventing fluid flow relative to said first bodies.

11. A compensator for use with a crown block and a traveling block supported by a mast, comprising:

a. two fluid pressure assemblies, each including a piston component and a cylinder component with one such component of each assembly fixed relative to said mast and the other such components interconnected by a rigid member, carrying first pulleys and reciprocably movable relative to said first components and therefore said mast;

b. means for applying fluid pressure to each of said fluid pressure assemblies tending to extend said fluid pressure assemblies and elevate said pulleys relative to said mast;

c. a crown block including one or more sheaves, and a traveling block including one or more sheaves;

d. a flexible line passing over one of said pulleys and arrayed alternately about said sheaves of said crown block and said traveling block and passing over the other of said pulleys whereby forces applied to the two ends of said flexible line provide support, by means of said pulleys and said mast, to said traveling block suspended from said crown block by said line, said pulleys being oriented generally parallel to said sheaves of said crown block and of said traveling block; and e. means for connecting said crown block to said other components carrying said pulleys comprising flexible line means, fixed at one end thereof relative to said crown block and fixed at the opposite end thereof relative to said mast, and passing about one or more second pulleys carried with said first pulleys, for each fluid pressure assembly, whereby said crown block is movable relative to said mast with proportional reciprocable motion between said piston and cylinder components of said fluid pressure assemblies while said traveling block may be fixed or selectively moved relative to said crown block.

12. Apparatus as defined in claim 17:

a. wherein one end of said flexible line is fixed relative to said mast; and b. further comprising means for selectively retracting or paying out said flexible line toward the opposite end thereof relative to said mast for selectively manipulating said traveling block relative to said crown block.

13. Apparatus as defined in claim 11 further comprising means for selectively anchoring said crown block relative to said mast.

14. Apparatus as defined in claim 11 wherein said flexible line passes over both said pulleys and about said crown block sheaves and said travelling block sheaves in the same rotational sense.

15. Apparatus as defined in claim 11 wherein:

a. said means for connecting said crown block to said other components carrying said pulleys may be operated separately from said pulleys over which said flexible line passes; and b. further comprising means for operating said flexible line for selectively manipulating said traveling block relative to said crown block, operable independently of said means for connecting said crown block to said other components carrying said pulleys.

16. Apparatus as defined in claim 11 wherein said two fluid pressure assemblies are sufficiently mutually spaced whereby said crown block may move between said fluid pressure assemblies.

17. Apparatus as defined in claim 11 wherein said pulleys over which said flexible line passes may be held against longitudinal movement relative to said mast independently of said fluid pressure assemblies, and while said flexible line may be selectively operated for selectively manipulating said traveling block relative to said crown block.

18. Apparatus as defined in claim 11 wherein said flexible line may be operated to raise said traveling block to said crown block, and thereby raise both said traveling block and said crown block relative to said mast.

19. Apparatus as defined in claim 11 further comprising fluid locking valve means for selectively locking said piston component relative to said cylinder component of each of said fluid pressure assemblies by preventing fluid flow relative to said cylinder components.

20. A compensator for use with a crown block and a traveling block supported by a mast, comprising:

a. a fluid pressure system, including at least one piston component and corresponding cylinder component with one of such components fixed relative to said mast and the other such component reciprocably movable relative to said first component and therefore said mast;

b. means for applying fluid pressure to said fluid pressure system tending to extend said fluid pressure components and elevate said movable component relative to said mast;

c. a crown block including one or more sheaves, and a traveling block including one or more sheaves;

d. means for connecting said crown block to said component reciprocably movable relative to said mast whereby said crown block is movable relative to said mast with proportional reciprocable motion between said piston and cylinder components;

e. at least two pulleys, and flexible line means, in each case fixed at one end thereof relative to said crown block and fixed at the opposite end thereof relative to said mast, for supporting assemblies carrying said pulleys to effect movement thereof proportional to movement of said crown block relative to said mast; and f. a flexible line passing over one of said pulleys and arrayed alternately about said sheaves of said crown block and said traveling block and passing over the other of said pulleys whereby force applied to said flexible line provides support, by means of said pulleys and said mast, to said traveling block suspended from said crown block by said flexible line.

21. Apparatus as defined in claim 20:

a. wherein one end of said flexible line is fixed relative to said mast; and b. further comprising means for selectively retracting or paying out said flexible line toward the opposite end thereof relative to said mast for selectively manipulating said traveling block relative to said crown block.

22. Apparatus as defined in claim 20 further comprising means for selectively anchoring said crown block relative to said mast.

23. Apparatus as defined in claim 22 wherein said flexible line may be operated to selectively manipulate said traveling block relative to said crown block while said crown block is so anchored relative to said mast.

24. Apparatus as defined in claim 20 wherein said mast may move relative to a reference while said crown block remains stationary relative to said reference accompanied by such proportional motion between said piston and cylinder components.

25. Apparatus as defined in claim 20 further comprising second means for applying fluid pressure to said fluid pressure system to resist reciprocation between said piston and cylinder components while permitting such reciprocation.

26. Apparatus as defined in claim 20 further comprising fluid locking valve means for selectively locking said piston component relative to said cylinder component by preventing fluid flow relative to said cylinder component.

* * * * *